US007299519B1

(12) United States Patent
Garry

(10) Patent No.: US 7,299,519 B1
(45) Date of Patent: Nov. 27, 2007

(54) COMBINATION TOILET PLUNGER AND BRUSH

(76) Inventor: Steven Garry, 2259 E. Glencove St., Mesa, AZ (US) 85213

( * ) Notice: Subject to any disclaimer, the term of this patent is extended or adjusted under 35 U.S.C. 154(b) by 769 days.

(21) Appl. No.: 10/729,693

(22) Filed: Dec. 5, 2003

(51) Int. Cl.
*A47K 11/10* (2006.01)
*A46B 9/00* (2006.01)

(52) U.S. Cl. ..... 15/104.05; 15/105; 15/160; 15/248.1; 4/255.11; 4/255.01

(58) Field of Classification Search ..... 206/361; 4/255.11, 255.01, 255.05; 15/105, 160, 405.04, 15/164, 248.1, 247, 184, 104.001, 104.16, 15/104.2, 104.33, 104.31
See application file for complete search history.

(56) References Cited

U.S. PATENT DOCUMENTS 1,018,939 A * 2/1912 Sterrick ..... 15/110
1,199,837 A * 10/1916 Thompson ..... 15/248.1
1,900,275 A 3/1933 Carter et al.
2,473,452 A 6/1949 Scott
4,174,548 A * 11/1979 Dunn ..... 15/104.33
4,417,364 A 11/1983 Hammond
D274,273 S 6/1984 Auerbach
4,700,423 A * 10/1987 Zuliani ..... 15/160
5,377,362 A 1/1995 Jackson
5,423,621 A * 6/1995 Russell ..... 401/9
5,423,624 A * 6/1995 Richards ..... 402/13
5,617,605 A 4/1997 Hoerner et al.
6,804,839 B1 * 10/2004 McMaster ..... 4/255.11

FOREIGN PATENT DOCUMENTS

DE 29716839 * 1/1998
DE 10029495 * 11/2001

* cited by examiner

*Primary Examiner*—Gary K. Graham
(74) *Attorney, Agent, or Firm*—Booth Udall, PLC

(57) ABSTRACT

A tool for both plunging and cleaning plumbing fixtures and drains includes a handle and a plunger and a cleaning brush both coupled to the same end of the handle. The plunger is moveable between an extended position in which it covers a majority of the brush, and a retracted position in which it exposes a majority of the brush. The tool may be used for cleaning with the plunger retracted and for plunging with the plunger extended. Exemplary embodiments are particularly useful for cleaning and plunging toilets using a combination toilet plunger and toilet brush.

17 Claims, 2 Drawing Sheets

COMBINATION TOILET PLUNGER AND BRUSH

BACKGROUND OF THE INVENTION

1. Technical Field

This invention generally relates to tools for cleaning plumbing drains and more specifically to a combination toilet plunger and brush tool in which the brush and plunger are coupled to the same end of a handle.

2. State of the Art

Toilet plungers and toilet brushes have been used for many years. Their general structure, methods of manufacture, function and usefulness are well known. A conventional plunger is generally made of some form of resilient rubber material that includes a concave region. When the plunger is pressed against a surface or into an opening, the space of the concave region is depressed and a suction is created as the concave region is moved back to its original shape. Plungers are commonly used for forcing water into and suctioning matter out of drains and other plumbing fixtures. For convenience in manipulating the plunging end of the plunger, toilet plungers include a long, straight, rounded handle rod that the user grasps when moving the plunger up and down.

Conventional toilet brushes include a plurality of flexible bristles extending from a center rod or a bristle surface. The rod or surface is generally coupled to a handle for easy manipulation. The handle for a toilet brush is generally much shorter than the handle of a plunger (⅓ to ⅔ the length). Methods and materials for making and using toilet brushes, like plungers, are well known in the art.

Both toilet brushes and toilet plungers generally come into contact with things found in a toilet and often become covered with toilet paper, excrement, or at least germ-laden toilet water. Unless the user actually uses fingers to pluck the material clinging to the brush or plunger, users generally shake the plunger or brush, or tap the plunger or brush on the side of the toilet to remove the contaminated materials before storage. Each of these movements, however, because of the restricted area available within the toilet bowl, frequently results in the toilet water and related toilet germs splattering outside of the toilet bowl.

Storage of toilet brushes and toilet plungers is conventionally maintained somewhere in the bathroom and is generally very unsightly. Toilet brushes and plungers are generally stored separately, each having an elongated handle that requires tall or wide storage space. In recent years, short plastic cases have been used to enclose and store the bristle portion of the brush on the floor next to the toilet.

Others have created combination brush and plunger tools that are not designed, intended or practical for many uses, including use with a toilet. In U.S. Design Pat. No. D274,273 to Auerbach (Jun. 12, 1984), Auerbach discloses a design for a garbage disposal thrust plunger and related brush. Different from a toilet plunger which creates suction to draw clogged materials from a drain, however, the plunger of Auerbach is a thrust stick to push items into a garbage disposal with short, rigid bristles on the end for scrubbing the disposal fixtures. The Auerbach tool could not be used to unclog a toilet by suction and is different from most conventional toilet brushes.

U.S. Pat. No. 5,617,605 to Hoemer et al. (Apr. 8, 1997) discloses a sink drain cleaning tool including a cleaning brush and plunger handle at one end, a plunger plate in the middle, and a brush handle at the other end. Apart from the shape of the plunger being designed specifically for a sink shape rather than a toilet shape, it is clear from the positioning of the two handles that the inventor did not contemplate its use for cleaning toilets. Use of this tool requires the user to grasp the brush end of the tool to plunge and the plunger end to brush. It is likely that the user's hand will come in contact with contaminated tool surfaces during use.

It would be advantageous in the cleaning industry to have an attractive combination cleaning and plunging tool to use in cleaning toilets. It would also be advantageous if that tool required less storage space than the two tools separately, and included a convenient way to remove some of the contaminants from the tool after it has been in the toilet, without splattering those contaminants outside of the toilet bowl.

DISCLOSURE OF THE INVENTION

Embodiments of the present invention relate to a combination plunging and cleaning tool comprising both a cleaning brush and a plunger on the same, first end of a handle. Specific embodiments relate primarily to the toilet cleaning industry and have plunger and cleaning brush components designed for use in a toilet. The tool's brush is placed inside the plunger of the tool. This allows for compact tool storage, ease of use, and a hidden brush when the tool is stored. In use, the plunger may be retracted from its extended position by a retractor mounted on the handle and coupled to the plunger. Moving the plunger from its extended to its retracted position exposes the brush to allow a user to scrub with the brush.

Additional components that are included in particular embodiments of the invention include a rotating sleeve and an L-, T- or X-shaped cross-member extending radially from the second end of the handle to allow for convenient and rapid rotation of the tool to remove contaminants. Additional features used in particular embodiments include a slip-resistant grip on the retractor to assist in maintaining the relative position of the retractor along the handle when the plunger is in its retracted position. The retractor may also include a connector coupling extending from the retractor grip to the plunger to attractively hide the plunger while functionally providing a mechanism to retract the plunger and expose the bristles of the brush.

While embodiments of the present invention may be useful in many cases where both a cleaning or scrubbing brush and a plunger are used, it is expected that the various embodiments are particularly useful as a tool for cleaning and plunging toilets. The foregoing and other features and advantages of the present invention will be apparent from the following more detailed description of the particular embodiments of the invention, as illustrated in the accompanying drawings.

DETAILED DESCRIPTION OF EMBODIMENTS OF THE INVENTION

Figure 1:
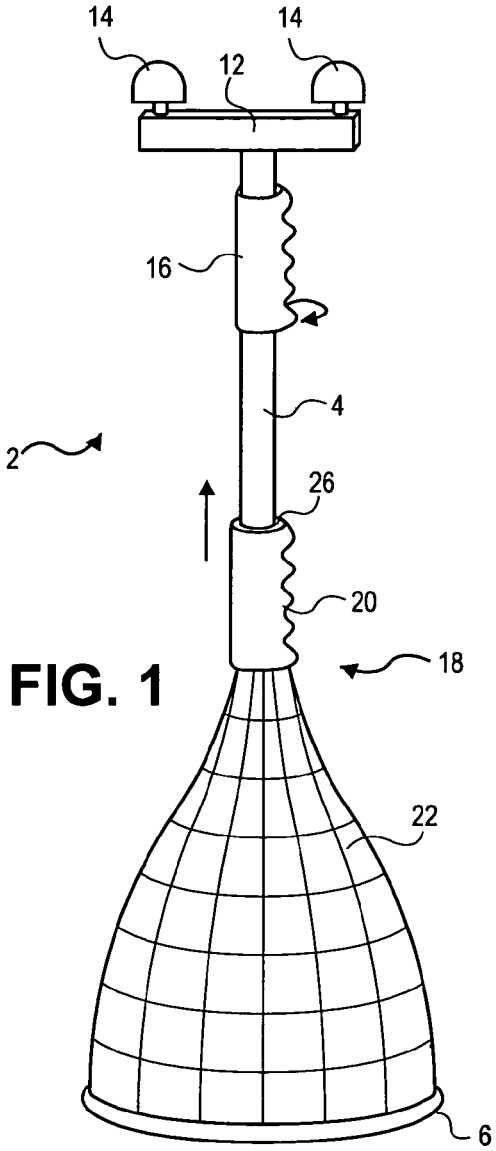
FIG. 1 is a perspective view of a combination plunger and brush according to a particular example embodiment of the present invention.

As discussed above, embodiments of the present invention relate to a combination plunger and brush tool particularly useful in cleaning and plunging toilets.

FIGS. 1-4 illustrate various views of one particular embodiment of a combination toilet plunger and toilet brush configured according to aspects of the present invention. The combination toilet plunger and brush tool 2 includes a handle 4 having a first end with a plunger 6 and one or more brush members 8 and/or 10 coupled to it, and a second end with a cross-member 12 and rotary handle 14 coupled to it. The various other elements indicated in the drawings assist in operating the combination tool 2.

The handle 4 of the tool 2 may be formed of any material and using any method conventionally used for forming a cleaning tool handle. Examples of possible materials include, but are not limited to, plastic, wood, rubber, metal, and the like. Because plastic is easy to mold to a desired shape, cleans easily, is lightweight, and inexpensive, it is a particularly useful material for forming many cleaning product parts. However, parts of other materials may alternatively be used, and the particular material used is not crucial to this invention.

The plunger portion 6 of the tool 2, like conventional plungers, is made of a resilient material that generally retains its shape, but allows itself to be significantly depressed and manipulated from its initial shape when a force is applied. Specific examples of resilient materials include, but are not limited to, rubber and silicon. Other materials well known in the art of plunger manufacture are suitable for this purpose and may be substituted so long as the plunger has enough shape retention to function as a plunger, yet can be manipulated to expose the brush 8 and/or 10, described in more detail hereafter. The precise shape of the plunger 6 is not crucial to the invention, though the plunger should generally include a concave portion with a substantially continuous surface extending about its opening that can create a suction when depressed against a surface or upon a drain.

As used herein, the term "concave" is intended to include not only generally curved, rounded or vaulted surfaces, but also other structures that include a hollow portion and an opening so that the structure, made of resilient material, can be collapsed or depressed to a size smaller than its shape-retaining size. Non-limiting examples of concave shapes include hemispheres, cones, boxes, pyramids, shapes of known plungers, and all other shapes and combinations of linear and nonlinear shapes and structures that include an opening and a recess to allow for collapsing of the shape for plunging and suction. The concave shape of the plunger 6 shown in FIGS. 1-4 is generally a bottle-shaped or cone-shaped structure with an opening facing away from the handle 4. The plunger 6 may be molded or formed by methods known in the art for molding or forming the material used to make the plunger 6. The particular line-shape for the curvature of the plunger 6 and radius of curvature and point where the curvature occurs is not crucial to the invention. As is explained herein, so long as the plunger 6 is permitted to retract to expose the brushes 8 and 10, any suitable radius of curvature or point at which the curvature occurs is sufficient for the invention. In particular, in a particular embodiment of the invention, the primary curvature for the plunger may occur at a point closer to the plunger so that the center brush 8 is more fully exposed when the plunger 6 is retracted. It is believed that those of ordinary skill in the art of plungers will readily be able to select an appropriate material for the plunger 6 and mould it or shape it to the appropriate shape and size from the explanation and description provided herein depending upon the particular application for the plunging tool.

Figure 2:
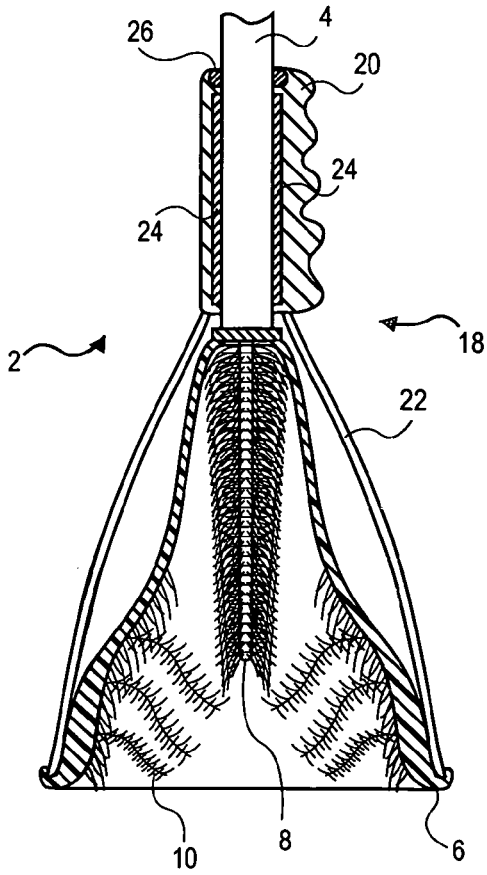
FIG. 2 is a cross-sectional view of a portion of the combination plunger and brush shown in FIG. 1 with the plunger in its extended position.
Figure 4:
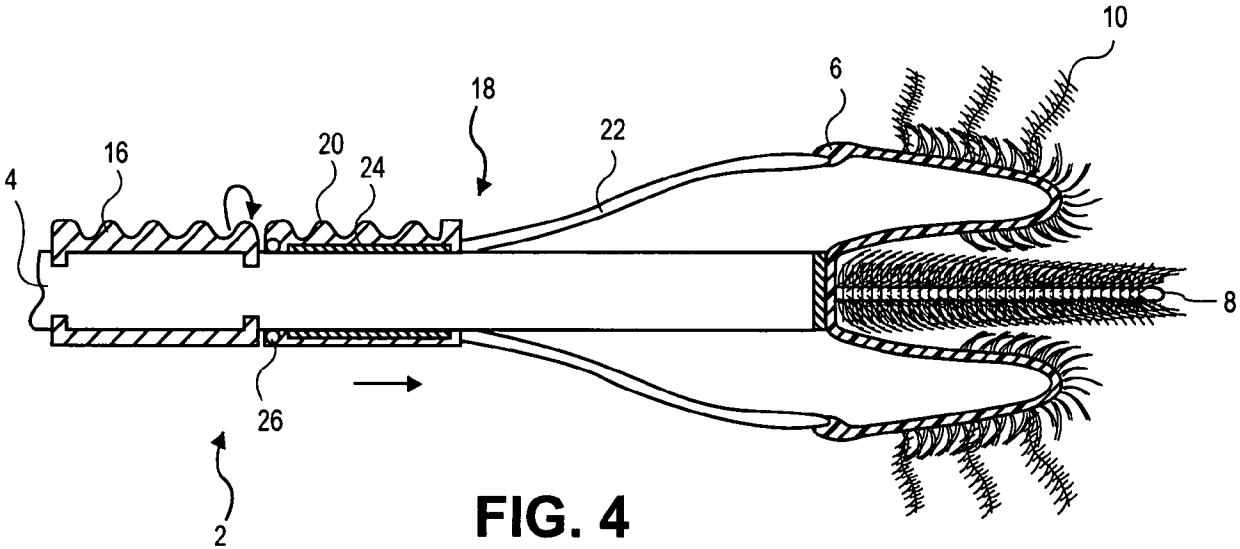
FIG. 4 is a cross-sectional view of a portion of the combination plunger and brush shown in FIG. 1 with the plunger in its retracted position.
Figure 5:
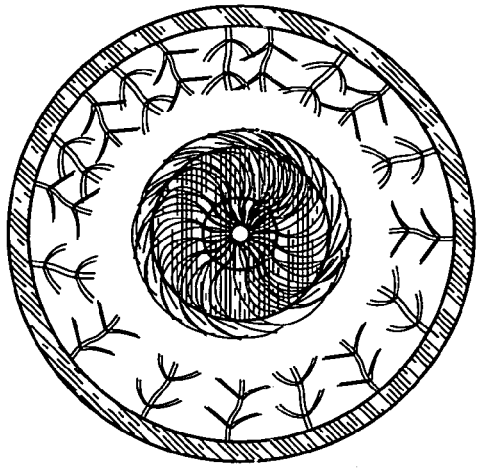
FIG. 5 is a close-up view of a cross-member with a rotary handle.
Figure 3:
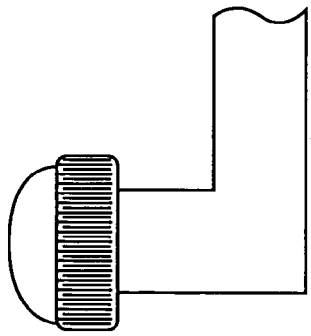
FIG. 3 is a bottom view of the combination plunger and brush shown in FIG. 1.

The embodiment of the tool 2 shown in FIGS. 2-4 includes both a center brush 8 and side brushes 10 for illustration. These brushes 8 and 10 may be referred to as portions of the same brush herein for convenience. While in some particular embodiments both center and side brushes 8 and 10 may be used, in other particular embodiments of the invention, brush 10 elements may be included only on the inside surface of the plunger 6 or only extending from the handle 4 of the plunger 6. Having brushes 8 and 10 extending both axially from the handle 4 and from the inside surface of the plunger 6, provides a better cleaning opportunity, however, and a broader brush area. The materials through which the brush and brush bristles may be made include all conventional brush-making materials such as nylon, plastic, rubber, coated metal, and the like. It is contemplated that in particular embodiments of the invention, wire bristles may be desirable depending upon the particular application in which the tool will be used. However, in most instances the brush materials will be formed from a resilient, durable material sufficient for scrubbing relatively smooth surfaces such as porcelain, plaster, polished metal, stone, and other surfaces typically found around plumbing drains.

The center brush 8 may be formed on the end of the handle 4, or attached or otherwise coupled to the handle 4 to extend into the plunger 6. It is contemplated that the center brush 8 may be permanently coupled to the handle 4 or may be replaceable when worn. Twisted wire brushes using nylon or plastic bristles are well known in the art. Another method of forming a brush is to mold nylon or plastic bristles into supporting surfaces. Such a supporting surface could be extended into the plunger 6. The side brushes 10 may be molded into the plunger 6 material during manufacture by methods known in the art of brush making. Alternatively, the brushes 10 may otherwise be attached to the inside surface of the plunger by a suitable adhesive, by heat welding, or other method of attachment. The manner of attachment is not crucial so long as the attachment of the brushes is durable enough to remain attached throughout the plunging and scrubbing action occurring when the tool is in use.

To make the retraction of the plunger 6 occur more easily, the side brushes 10 are preferably short and/or flexible so as to not interfere significantly with the center brush 8 where both a center brush 8 and side brushes 10 are used in the same tool. Many plastics and nylons are flexible enough to enable inversion of the portion of the plunger 6 with the side brushes 10 without significant interference with a center brush 8. Alternatively, as mentioned earlier, shorter bristles, regardless of their resilience or flexibility, may accomplish the same result. The resilience or flexibility of the bristles will depend, primarily, upon the density and length of the bristles, the particular tool design selected, and the intended use of the tool. It is believed that those of ordinary skill in the art of cleaning brush manufacture and design will readily be able to select an acceptable combination of materials, size and design from the present disclosure. As can be seen in FIGS. 1 and 2, the plunger in the extended position substantially covers the brushes 8 and 10, or at least a majority of the brush, for storage.

In particular embodiments of the present invention one or more cross-members 12 may be extended in a radial direction from the handle 4 of the tool 2. The cross-members 12 serve primarily two functions. First, use of one or more cross-members provides a convenient and comfortable handle for the plunger and brush tool that is more comfortably manipulated by a user of the tool than the straight pole handle typical of conventional plungers and brushes. This is particularly helpful when plunging a toilet. Second, inclusion of one or more cross-members allows a user to rapidly and easily spin the tool about its longitudinal axis to cause contaminants to be thrown from the tool due to centripetal force while the plunger of the tool is still within the bowl. This is expected to significantly reduce the splatter caused by shaking a plunger or brush, or tapping it on the side of the bowl. Additionally, the rotation movement of the brush may allow for additional scrubbing action in the bowl if used while cleaning the bowl with the brush. In particular embodiments of the invention, one or more of the cross-members 12 include a rotatable knob 14 at or near and end of the cross-member 12. The knob 14 is designed so that it can rotate freely on the end of the cross-member 12. Additionally, in embodiments comprising a knob 14, a pivoting sleeve 16 is also coupled to the handle such that a user grasping the pivoting sleeve 16 with one hand and the rotatable knob 14, can spin the tool along the longitudinal axis of the handle 4 to increase the centripetal force and likelihood that contaminants will be thrown from the tool. Additionally, by including one or more cross-members, the overall length of the handle may be made shorter than that of a conventional plunger. While the particular shape of the cross-members and the number of radially extending members is not crucial, it is expected that one to four cross-members forming any of an L, T, Y and X shape will be typical. Optionally, the rotation may be made battery powered by adding a simple rotary motor and battery within the handle or cross-member, and a trigger switch hear the pivoting sleeve 16.

A retractor 18 may also be included on the tool to assist in moving the plunger from an extended position (FIGS. 1 and 2) to a retracted position (FIG. 4). Alternatively, the user grasping the end of the plunger and manually turning it inside out could accomplish this. In most cases, however, use of a convenient retractor-like device to expose the brush 8 or 10 will understandably be preferred. FIGS. 1, 2 and 4 show a retractor grip 20 and a cone-shaped connector 22 extending from the retractor grip 20 to an outer surface of the plunger 6. By coupling the connector 22 from the retractor grip 20 to the plunger 6, translational movement of the retractor grip 20 along the handle 4 from a first position (FIG. 2) to a second position (FIG. 4) results in movement of the plunger from an extended position (FIG. 2) to a retracted position (FIG. 4). A comfort grip (i.e. foam or soft rubber), and/or finger indentations may also be included as part of the retractor grip.

In particular embodiments of the retractor grip 20, an inner surface 24 of the retractor grip 20 is equipped with a friction-increasing coating or layer (such as rubber, silicon, a textured metal or plastic surface or the like), and the retractor grip 20 is made firm but flexible. In such embodiments, a user may squeeze the retractor grip 20 to cause the friction-increasing surface 24 to frictionally engage the plunger handle 4 and engage resistance against the plunger 6 moving back to its extended position. Examples of slip-resistant devices and reduced-slip handles easily adaptable to embodiments of the present invention may be found in U.S. Pat. No. 6,212,727 to Bendor (issued Apr. 10, 2001) entitled Twist-Type Mop, the disclosure of which is hereby incorporated herein by reference.

Alternatively, the pivoting sleeve 16 and the retractor grip 20 may be incorporated into a single pivoting retractor grip 20. This may be accomplished by adding an additional sleeve (not shown) over the portion of the handle 4 extending through the retractor grip 20, and, similar to the pivoting sleeve 16, causing the retractor grip 20 to pivot on the additional sleeve. The cover 22 would be attached to the end of the additional sleeve to allow the retractor grip 20 to pivot without rotating the cover 22. The handle 4 would extend through the additional sleeve and be coupled to the brushes 8 and 10. The retractor grip 20 would then be pivotable around the additional sleeve, and transversely moveable along the length of the handle 4 by sliding the sleeve as the earlier embodiment of the retractor grip 20 did along the handle. The additional sleeve is included so that any brushes 8 and 10 within the plunger 6 may be freely rotated within the retractor grip 20 by rotating the cross-member 12 and attached handle 4 within the additional sleeve. To enable the retractor grip 20 to grip the handle, the additional sleeve may be made to have an inner surface with an increased friction, the retractor grip 20 and additional sleeve being made flexible to allow a user to squeeze the inner surface against the handle 4. Alternatively, the additional sleeve may be made with openings and the retractor grip 20 made with friction members that press against the handle 4 through the openings in the additional sleeve when a user squeezes the retractor grip 20.

The connector 22 may be formed of any material having sufficient strength to cause the plunger to move from the extended position to the retracted position. In embodiments where the plunger 6 does not automatically return to its extended position when released (due to the memory of the resilient materials used for the plunger 6), the connector 22 should also be of sufficient rigidity to push the plunger 6 to its extended position when the retractor grip 20 is moved to its first position (FIG. 1). While many materials are contemplated for possible use for the connector, plastic works particularly well because it is inexpensive, easily moldable and formable to an appropriate shape, is durable, can be made virtually any color desirable to create an aesthetically pleasing look for the tool, and can be made with sufficient rigidity to push the plunger 6 if needed. A lightweight metal such as aluminum is also specifically contemplated for use as the connector 22 to form some or all of the components for connecting the retractor grip 20 to the plunger 6.

The connector 22 may be formed integrally with the retractor grip 20 or otherwise adhered thereto if conventional manufacturing processes dictate such, and may be adhered to the plunger 6 with an appropriate adhesive, or otherwise coupled to the plunger 6 by other methods known in the art. The adhesive needs to be of sufficient strength to maintain the connection between the plunger opening and the connector 22 when the plunger 6 is being moved to its retracted position. While the connector 22 is shown here as a solid piece, this is not required to practice the invention. All that is needed to practice the various embodiments of the invention is a sufficient number of connection points between the plunger 6 and the retractor grip 20 to draw the plunger 6 open to expose the brushes 8 and/or 10.

While it is not required as part of the invention to create a sealed tool system, in many situations it is desirable to seal the plunger end of the system against fluid entry because the tool is often used in places where mildew, germs or unsanitary fluids are found. This can be done by use of a water-proof sealant or adhesive between the base of the cone 22 and the plunger 6 along a continuous circumferential surface of the plunger and use of a water-proof or water-resistant connector 22. In particular specific embodiments, a ring seal or gasket 26 between the retractor grip 20 and the handle 4 to keep fluids from draining down the handle 4 into the grip 20 and connector 22 may be used. Ring seals 26 for restricting fluid flow, their use and manufacture are well known in the art. A conventional ring seal 26 could be seated within a seat at or near the upper end of the retractor grip 20.

When the plunger 6 is in its retracted position with the brush 8 and/or 10 exposed, the tool 2 may be used for cleaning just like a standard cleaning brush. The brush elements on the inner surface of the plunger 6 may extend throughout the concave surface of the plunger 6, or may stop at or just beyond the portion of the concave surface that is not inverted when the plunger 6 is moved to its retracted position. Similarly, in embodiments where a center brush 10 is used, its bristles may extend fully or stop at the point on the brush 10 where the bristles will no longer be used.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. A combination cleaning and plunging tool comprising:

a handle having a first end and a second end;

a resilient plunger coupled to the first end of the handle, the plunger having a concave portion with an opening facing generally away from the second end of the handle, the plunger further having at least an extended position and a retracted position;

a brush coupled to at least one of the first end of the handle and to the plunger, the brush comprising a first brush portion coupled to an inside surface of the plunger in its extended position; and wherein at least a majority of the brush is within the concave portion of the plunger when the plunger is in its extended position, and at least a portion of the brush is exposed from the concave portion of the plunger when the plunger is in its retracted position.

2. The combination cleaning and plunging tool of claim 1, wherein the brush comprises a second brush portion coupled to the first end of the handle and extending axially therefrom within the plunger in its extended position.

3. The combination cleaning and plunging tool of claim 1, wherein the first brush portion coupled to the inside surface of the plunger comprises a plurality of brush bristles and a majority of the brush bristles are exposed from the concave portion of the plunger when the plunger is in its retracted position.

4. The combination cleaning and plunging tool of claim 1, wherein the brush comprises an elongated brush portion coupled to the first end of the handle and extending axially therefrom within the plunger in its extended position.

5. The combination cleaning and plunging tool of claim 1, further comprising a cross-member extending in at least one radial direction from the handle at or near the second end of the handle.

6. The combination cleaning and plunging tool of claim 5, wherein the cross-member extending in a radial direction from the handle comprises a rotatable knob thereon, the handle further comprising a sleeve rotatably mounted on the handle such that when a user grasps the rotatable sleeve with one hand and the cross-member knob with the other hand, the user can rotate the knob to cause the handle to rotate within the sleeve.

7. The combination cleaning and plunging tool of claim 1, further comprising a retractor coupled to the plunger and adjustably coupled to the handle, the retractor moveable between a first position in which the retractor moves the plunger into its extended position, and a second position in which the retractor moves the plunger into its retracted position.

8. The combination cleaning and plunging tool of claim 7, wherein the retractor is slidably mounted on the handle such that movement of the retractor from its first position to its second position moves the retractor transversely along the handle in the direction of the second end of the handle.

9. The combination cleaning and plunging tool of claim 8, the retractor further comprising a grip portion having an inner surface formed of a friction material such that when the grip portion is squeezed, the friction surface presses against the handle to restrict transverse movement of the handle within the retractor grip.

10. The combination cleaning and plunging tool of claim 9, the retractor further comprising a sleeve rotatably mounted on the handle such that the handle can rotate within the sleeve.

11. The combination cleaning and plunging tool of claim 1, wherein the brush is a toilet brush and the plunger is a toilet plunger.

12. A combination cleaning and plunging tool comprising:

a handle having a first end and a second end;

a resilient plunger coupled to the first end of the handle, the plunger having a concave portion with an opening facing generally away from the second end of the handle, the plunger further having at least an extended position and a retracted position;

a brush coupled to at least one of the first end of the handle and to the plunger; and a retractor coupled to the plunger and adjustable coupled to the handle, the retractor further comprising a substantially cone-shaped member extending between the retractor and a circumferential surface of the plunger, wherein movement of the retractor from its first position to its second position draws the circumferential surface of the plunger toward the handle resulting in the plunger being placed in its retracted position with the portion of the brush exposed;

wherein at least a majority of the brush is within the concave portion of the plunger when the plunger is in its extended position, and at least a portion of the brush is exposed from the concave portion of the plunger when the plunger is in its retracted position.

13. A combination cleaning and plunging tool comprising:

a handle having a first end and a second end;

a resilient toilet plunger coupled to the first end of the handle, the toilet plunger having a concave portion with an opening facing generally away from the second end of the handle, the toilet plunger further having at least an extended position and a retracted position;

a toilet brush coupled to at least one of the first end of the handle and to the toilet plunger, wherein the brush comprises a first brush portion coupled to an inside surface of the toilet plunger in its extended position; and a retractor coupled to the toilet plunger and adjustably coupled to the handle, the retractor moveable between a first position in which the retractor moves the toilet plunger into its extended position, and a second position in which the retractor moves the toilet plunger into its retracted position;

wherein at least a majority of the toilet brush is within the concave portion of the toilet plunger when the toilet plunger is in its extended position, and at least a portion of the toilet brush is exposed from the concave portion of the toilet plunger when the toilet plunger is in its retracted position.

14. The combination cleaning and plunging tool of claim 13, wherein the brush comprises a second brush portion coupled to the first end of the handle and extending axially therefrom within the plunger in its extended position.

15. The combination cleaning and plunging tool of claim 13, wherein the retractor is slidably mounted on the handle such that movement of the retractor from its first position to its second position moves the retractor transversely along the handle in the direction of the second end of the handle.

16. The combination cleaning and plunging tool of claim 13, the retractor further comprising a sleeve rotatably mounted on the handle such that the handle can rotate within the sleeve.

17. A combination cleaning and plunging tool comprising:

a handle having a first end and a second end and a cross-member extending in a radial direction from the handle at or near the second end of the handle comprising a rotatable knob thereon, the handle further comprising a sleeve rotatably mounted on the handle such that when a user grasps the rotatable sleeve with one hand and the cross-member knob with the other hand, the user can rotate the knob to cause the handle to rotate within the sleeve;

a resilient toilet plunger coupled to the first end of the handle, the toilet plunger having a concave portion with an opening facing generally away from the second end of the handle, the toilet plunger further having at least an extended position and a retracted position;

a toilet brush coupled to at least one of the first end of the handle and to the toilet plunger; and a retractor coupled to the toilet plunger and adjustable coupled to the handle, the retractor moveable between a first position in which the retractor moves the toilet plunger into its extended position, and a second position in which the retractor moves the toilet plunger into its retracted position;

wherein at least a majority of the toilet brush is within the concave portion of the toilet plunger when the toilet plunger is in its extended position, and at least a portion of the toilet brush is exposed from the concave portion of the toilet plunger when the toilet plunger is in its retracted position.

* * * * *